US006800376B1

(12) United States Patent
Gupta et al.

(10) Patent No.: US 6,800,376 B1
(45) Date of Patent: Oct. 5, 2004

(54) GAS TURBINE ENGINE COMPONENT HAVING A REFURBISHED COATING INCLUDING A THERMALLY GROWN OXIDE

(75) Inventors: Bhupendra Kumar Gupta, Cincinnati, OH (US); Nripendra Nath Das, West Chester, OH (US); Lyle Timothy Rasch, Fairfield, OH (US); Jeffrey Allen Conner, Hamilton, OH (US); Michael James Weimer, Loveland, OH (US)

(73) Assignee: General Electric Company, Schenectady, NY (US)

( * ) Notice: Subject to any disclaimer, the term of this patent is extended or adjusted under 35 U.S.C. 154(b) by 93 days.

(21) Appl. No.: 10/262,113

(22) Filed: Sep. 30, 2002

Related U.S. Application Data

(62) Division of application No. 09/777,636, filed on Feb. 6, 2001, now Pat. No. 6,465,040.

(51) Int. Cl.[7] ..... B32B 15/00; F03B 3/12

(52) U.S. Cl. ..... 428/612; 428/632; 428/650; 428/679; 428/680; 428/681; 416/241 R

(58) Field of Search ..... 428/632, 650, 428/612, 680, 687, 679, 681, 655; 416/241 R

(56) References Cited

U.S. PATENT DOCUMENTS 5,900,102 A * 5/1999 Reeves ..... 156/344
6,158,957 A * 12/2000 Marcin et al. ..... 415/200
6,174,380 B1 * 1/2001 Rosenzweig et al. ..... 134/1

* cited by examiner

*Primary Examiner*—Jennifer McNeil
(74) *Attorney, Agent, or Firm*—David L. Narciso; Lee H. Sachs

(57) ABSTRACT

A method is provided for refurbishing a service operated metallic coating on a substrate alloy, the coating including at least within a coating outer surface at least one oxide chemically grown from at least one coating element, for example Al, and chemically bonded with the coating outer surface as a result of thermal exposure during service operation. Growth of the oxide has depleted at least a portion of the coating element from the coating. The method comprises removing the oxide from the coating outer surface while substantially retaining the metallic coating, thereby exposing in the coating outer surface at least one surface void that had been occupied by the oxide. The retained metallic coating is mechanically worked, substantially without removal of the retained coating, to close the void, providing a treated metallic coating surface over which a refurbishing coating is applied. In one form, the mechanical working provides, concurrently, a compressive stress in the substrate alloy beneath the metallic coating.

4 Claims, 1 Drawing Sheet

GAS TURBINE ENGINE COMPONENT HAVING A REFURBISHED COATING INCLUDING A THERMALLY GROWN OXIDE

This application is a division of application Ser. No. 09/777,636, filed Feb. 6, 2001, now U.S. Pat. No. 6,465,040, for which priority is claimed and whose disclosure is incorporated by reference.

BACKGROUND OF THE INVENTION

This invention relates to repair or refurbishment of a metallic coating including a surface oxide grown from at least one element of the coating as a result of exposure of the metallic coating to oxidizing conditions at an elevated temperature. More particularly in one form, it relates to a metallic coating including the element Al on a metallic article, in one specific form including a substantially uncoated article portion, for example a gas turbine engine blading member including a substantially uncoated radially inward blade base portion.

In the development of certain components operating in the hotter sections of modern gas turbine engines, it had been recognized that structural metal alloy materials from which such components are made alone are unable effectively to resist surface deterioration from the strenuous operating conditions, even with air cooling capability. For example, a high temperature environment to which the component surface is exposed includes oxygen and products of fuel combustion as well as airborne particles. As a result, a variety of types of surface protective coatings have been developed and reported for commercial application to such components, generally made from a mechanically strong superalloy based on at least one of Fe, Co, and Ni.

A gas turbine engine turbine blade made of a commercially available Ni base superalloy is a typical example of such a component. It has become common practice to protect the blade surface exposed during service operation to the strenuous environmental conditions with a metallic coating including the element Al. A wide variety of such metallic coatings have been reported and used on production gas turbine engine components including shrouds, bands, and blading members such as rotating blades, and stationary blades, vanes and struts. Such commercial coatings include diffused aluminides, a commercial form of which sometimes is called Codep aluminide coating, deposited by such diffusion deposition methods as pack cementation, within or above a pack, by vapor phase aluminiding, etc. Another of such metallic coatings is the Pt—Al type coating in which Pt first is deposited, such as by electrodeposition, on a surface that subsequently is diffusion aluminided. Still another type of such metallic coating is a metallic overlay coating of the M—Al type in which M is at least one element selected from Fe, Co, and Ni, for example MAl, MAlY, MCrAl, and MCrAlY. The M—Al types of coating can be applied by such methods as physical vapor deposition, including sputtering, cathodic arc, electron beam, and plasma spray. Sometimes such coatings including Al are not used as an outer protective coating but have been used as an intermediate or bond coat beneath an outer non-metallic ceramic thermal barrier coating disposed over the coating including Al.

When a metallic coating including Al, for example used as the outer coating for a turbine engine component, is exposed to the above described type of strenuous service operating conditions, aluminum oxide is grown thermally at the component outer surface from Al in the coating. Such generation of the oxide depletes Al from the coating and can reduce the protective capability of the coating. This is particularly significant with the above described M—Al type overlay coating that generally includes less Al, for example in the range of about 10–20 weight %, than the diffusion aluminide coatings. Formation of surface aluminum oxide from an overlay coating can reduce the Al content to less than about 10 wt. %, typically to the undesirable range of about 5–10 wt. %. During repair of a turbine engine component from service operated damage or as a result of excessive Al depletion from the protective coating, it is necessary to remove the surface thermally grown oxides to enable repair and/or coating refurbishment or replacement.

Reported methods for removal of the surface oxide include use of a halogen ion, for example fluoride ion alone or in combination with a reducing gas such as hydrogen, to convert the oxide to a halide vapor. Other methods include use of abrasive blasting or mechanical means such as machining or grinding, that removes at least a portion of the metallic coating as well as the oxide. Another method includes the use of chemical solutions such as relatively strong caustics and/or acids to remove the oxide and the coating. However, some components, for example gas turbine engine rotating turbine blades, typically include a portion at least on the radially inner surface of the blade base, which has no need for and generally does not include a protective coating. It has been observed that use of such known methods involving halide ion and relatively strong chemical solutions can result in undesirable intergranular attack of such uncoated surface.

BRIEF SUMMARY OF THE INVENTION

The present invention, in one form, provides a method for refurbishing a service operated metallic coating, for example the above described type of metallic overlay coating, on a substrate alloy surface. The service operated coating includes at least within a coating outer surface at least one oxide, for example aluminum oxide, chemically grown from at least one coating element, for example Al, and chemically bonded with the coating outer surface as a result of thermal exposure during service operation. Growth of the oxide depletes at least a portion of the coating element from the coating.

The method comprises removing the chemically grown oxide from the coating outer surface by a means which substantially only affects the oxide and does not affect the underlying coating or an exposed substrate alloy surface. For example, such removal can be mechanically by a controlled relatively light grit blasting and/or a relatively weak acid solution such as acetic acid. The metallic coating depleted, during operation, of at least a portion of the coating element, for example Al, substantially is retained during such oxide removal. This action exposes in the coating surface at least one surface void that had been occupied by the oxide. If the oxide extends substantially across the coating surface, the exposed void or voids appear as a roughened surface.

The retained metallic coating surface with the exposed void or voids is mechanically worked such as by impacting, rather than being abraded, for example mechanically worked by a commercial tumbling method, substantially without removing the retained coating. Such working closes the void, and provides a coating surface finish of no greater than about 60 microinch Roughness Average (RA). Concurrently, the working provides a compressive stress in the substrate surface and the coating. This provides a treated metallic coating outer surface over which a refurbishing coating is applied.

DETAILED DESCRIPTION OF THE INVENTION

Figure 1:
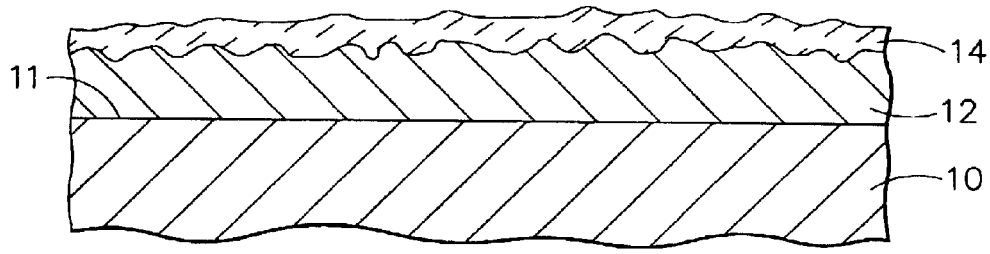
FIG. 1 is a diagrammatic, fragmentary sectional view of a substrate surface including a metallic environmentally resistant coating from which a surface oxide has grown chemically as a result of thermal exposure during service operation.

Of particular interest in the practice of one form of the present invention is the repair and refurbishment of the airfoil, and sometimes the platform or supporting bands, of gas turbine engine turbine blading members made from a high temperature superalloy, and coated with the above-described M—Al type environmental resistant metallic overlay coating. As a result of service operation at elevated temperatures under oxidizing conditions, aluminum oxide has been generated on the surface of the metallic coating. It has been common practice, as widely described in the art, to remove such oxide prior to repair and/or coating replacement or enhancement by relatively long time exposure to relatively strong aqueous chemical solutions, for example strong caustic and/or acid solutions. Another common practice is exposure of the oxidized metallic coating to a reducing atmosphere including halide ions, alone or in combination with hydrogen.

In many embodiments of such a component or article, there is a substrate surface portion of the component on which such an environmentally resistant coating substantially is absent and has not been applied because such portion is not exposed to strenuous service operating conditions. An example of such a portion is the radially inner surface of the base of a turbine blade disposed or carried in a member away from the hot gas stream flow through the turbine of a gas turbine engine. It has been observed that exposure of such uncoated portion to strong aqueous solutions or to the reducing halide gas has resulted in an undesirable intergranular attack on such portion and/or the chemical removal of substrate alloy. If cooling passages communicate through such surface, the size of the cooling openings can be enlarged thereby altering the designed flow of cooling air.

According to a form of the present invention, a service operated metallic coating including such a thermally grown surface oxide can be refurbished without exposure to undesirable, damaging chemical solutions or halide gas. In a form of the present method, the oxide is removed from the surface of a gas turbine engine blading component airfoil substantially without other effect on, and retaining, the metallic coating. Such removal is accomplished without adversely affecting any substrate surface portions on which the metallic coating substantially is absent. Removal of the oxide exposes, in a coating outer surface, at least one surface connected void, and generally a plurality of voids, that had been occupied by the removed oxide. Formation of such oxide on the surface of the above described M—Al overlay type of environmental resistant coating, typically an MCrAlY overlay coating originally including only about 10–20 wt. % Al, and generally about 15–20 wt. %, can significantly reduce the protective ability of the coating by reducing the Al content of the coating to less than about 10 wt. % Al. In such an instance, enhancement or refurbishment of such overlay coating is required before the coating is returned to service operation.

In one typical example, the coating surface from which the oxide had been removed by the combination of a mechanical light grit blast and a weak acetic acid aqueous solution had a roughened, irregular appearance, with a surface finish greater than about 60 microinch RA. Application during component repair of a final refurbishing or enhancing metallic coating over the existing, retained coating could at least reproduce the roughened retained coating surface, resulting in a roughened final coating having a surface of undesirable roughness for use in a gas flow stream. Such surface roughness can develop undesirable turbulence in the gas stream.

According to embodiments of the present invention, the roughened, retained coating surface from which the oxide had been removed is mechanically worked substantially without abrading away the coating. Mechanical working, as used herein, includes a rubbing, burnishing, peening, impacting type action, as contrasted with an aggressive blasting, honing or abrading action that can remove the retained coating. The mechanical working closes the voids and smooths the surface to a surface finish of no greater than about 60 microinch RA. It has been recognized that a surface finish after oxide removal of greater than about 60 microinch RA, undesirable for use in the gas stream of a gas turbine engine turbine section, can be reproduced and even increased in intensity by subsequent enhancement, refurbishing coating. Impacting the roughened surface also, concurrently, provides in the surface a compressive stress that increases at least one mechanical property of the substrate, for example improvement in fatigue strength. After impacting to smooth the roughened surface and to provide a treated, metallic coating surface, a refurbishing metallic coating was applied over the treated surface.

The present invention will be more clearly understood by reference to the embodiments in the drawing. FIG. 1 is a diagrammatic fragmentary sectional view of a metal article substrate 10 including a substrate surface 11 having thereon a metallic overlay type of surface coating 12 including Al. A surface aluminum oxide 14 has grown over surface coating 12 from thermal exposure to oxidizing conditions during service operation. Practice of an embodiment of the present invention includes mechanically removing by a light grit blast the surface oxide 14 to result in the structure shown in FIG. 2 in which metallic surface coating 12 substantially is retained.

Figure 2:
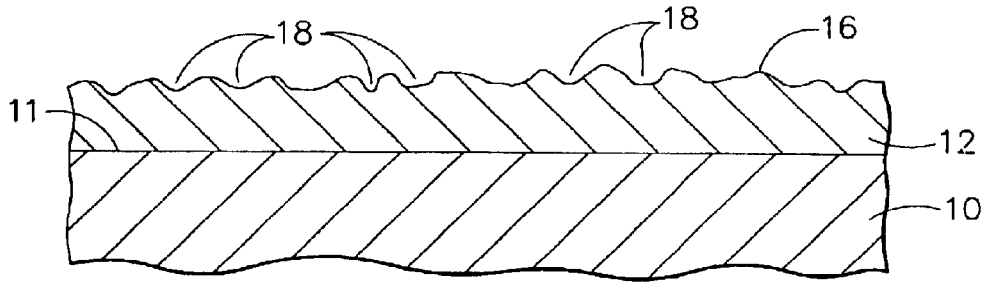
FIG. 2 is an enlarged view of the structure of FIG. 1 showing a retained metallic coating including surface connected voids exposed from removal of the oxide.

FIG. 2 is an enlarged diagrammatic fragmentary sectional view of the structure of FIG. 1 after surface oxide 14 has been removed, with coating 12 substantially retained. Removal of oxide 14 has exposed in retained coating surface 16 of coating 12 a plurality of surface connected voids 18 previously occupied by oxide 14. In the embodiment of the drawing, oxide 14 substantially was continuous across coating 12, providing the surface 18 with a surface roughness of greater than about 60 microinches RA. Application of a metallic refurbishing coating over such a surface would substantially reproduce or increase such surface roughness in the final refurbishing coating.

Figure 3:
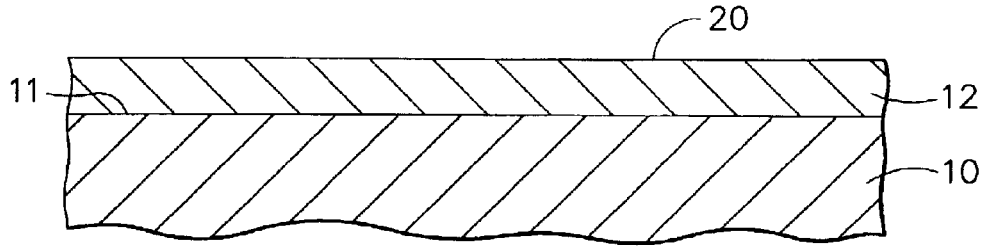
FIG. 3 is a view as in FIG. 2 after mechanically working the metallic coating surface by impacting to close the voids substantially without removing the coating.
Figure 4:
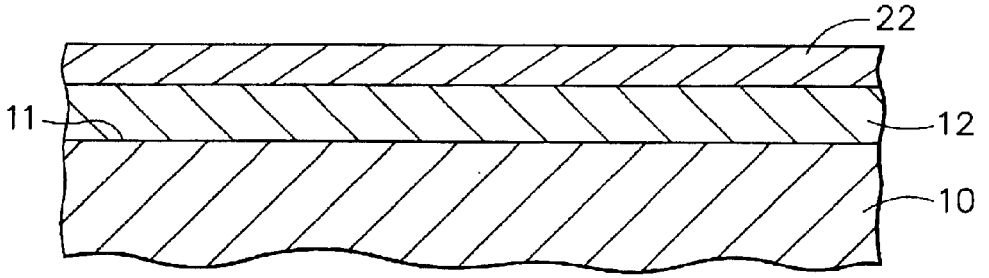
FIG. 4 is a view of the structure of FIG. 3 on which a refurbishing coating has been applied.

According to a form of the present invention, retained coating surface 16 was mechanically worked by tumbling to close voids 18 and to reduce surface roughness to about 30 microinch RA, well below about 60 microinches RA. Concurrently, the mechanical working provided a compressive stress in substrate 10 beneath coating 12. This provided a treated metallic coating surface 20, as shown in FIG. 3. Then a metallic refurbishing coating 22, FIG. 4, was applied over treated surface 20. Application of refurbishing coating 22 over treated surface 20 can be accomplished by a variety of commercially used methods, for example diffusion aluminiding, including pack, slurry, or vapor phase methods, with or without a first deposit of an enhancing metal such as Pt.

In an evaluation of the present invention, a gas turbine engine turbine blade, made of a high temperature Ni base alloy, commercially available as Mar-M 200 alloy, included an environmental resistant NiCoCrAlY type of overlay coating. In one example, the overlay coating comprised, by weight, about 16–20% Co, 14–20% Cr, 15–20% Al, and the balance Ni, with small amounts of Y and Si. From an inspection of the blade after service operation, it was determined that the blade required repair as a result of such operation. Included on a surface of the airfoil of the blade was a thermally grown oxide, predominantly aluminum oxide, which required removal prior to repair. Thermal growth of the oxide from the overlay coating had reduced the Al content of the overlay coating to less than about 10 wt. %, in this example to about 6 wt. % at the coating surface, a level below that specified for service operation. Therefore, coating enhancement or refurbishment was required in the repair before the blade could be returned to service operation.

The surface oxide was removed by a combination of a very light mechanical grit blasting of the oxide with an aluminum oxide grit in the size range of about 150–240 mesh and then chemically using a 5–10% aqueous solution of acetic acid. Removal of the oxide substantially retained the underlying overlay coating while exposing in the retained coating surface a plurality of voids previously occupied by the surface oxide. Removal of the oxide and the presence of the surface voids resulted in a surface finish of about 100 microinch RA, an amount greater than a specified surface finish in the range of less than about 60 microinch RA.

It was recognized that, because refurbishing coating by aluminiding, selected for the repair, would at least reproduce such surface roughness, the surface of the retained coating was treated to reduce the roughness level. Reduction of surface roughness was accomplished, substantially without affecting or abrading away the retained coating according to a form of the present invention, by mechanically working through impacting the retained coating surface by tumbling. Tumbling was conducted in a commercial tumbling barrel using commercial aluminum oxide tumbling pellets in the size range of about 1/16–1/2" in diameter for about 2–4 hours to provide a treated surface. After working by tumbling, which concurrently introduced compressive stress in the substrate surface, the surface finish of the treated surface was in the range of about 30–40 microinch RA, less than the maximum allowable amount of 60 microinch RA.

The overlay coating including the treated surface was refurbished to increase the Al content to about 28–35 wt %, at least to the specified range. The refurbishing coating was applied by a commercial Vapor Phase Aluminide (VPA) process conducted at about 1975° F for about 6 hours using CrAl pellets as the source of Al. The surface roughness of the refurbished coating was in the range of about 30–40 microinch RA.

In some examples, a refurbishing coating method resulted in a refurbishing coating roughness of greater than about 60 microinch RA. In other examples, a still smoother coating than that resulting from the refurbishing coating was desired. In such instances, a mechanical working, for example as described above, of the refurbishing coating was be repeated. This was accomplished without removal of the refurbishing coating to reduce the surface roughness to the specified or desired range.

The present invention has been described in connection with specific examples of materials, methods, combinations, etc. However, it should be understood that they are intended to be typical of rather than in any way limiting on the scope of the present invention. Those skilled in the various arts involved will understand that the invention is capable of variations and modifications without departing from the scope of the appended claims.

What is claimed is:

1. A gas turbine engine component refurbished by a method having the steps of furnishing a service-operated metallic coating on a substrate alloy surface, the metallic coating including at least within a coating outer surface at least one oxide chemically grown from at least one coating element and chemically bonded with the coating outer surface as a result of thermal exposure during service operation, thereby depleting at least a portion of the coating element from the coating; and, removing the oxide from the coating outer surface while substantially retaining the metallic coating as a retained coating thereby exposing in the coating outer surface at least one surface void that had been occupied by the oxide; wherein:

the retained metallic coating is subjected to mechanical working, substantially without removal of the retained metallic coating, substantially to close the void to provide a treated metallic coating outer surface; and a refurbished coating is applied over the treated coating outer surface.

2. The component of claim 1 in which:

the metallic coating includes the element Al and the substrate alloy is a high-temperature alloy based on at least one element selected from the group consisting of Fe, Co, and Ni;

the oxide is an aluminum oxide chemically grown from Al in the metallic coating thereby depleting Al from the metallic coating;

the removing of the oxide from the coating outer surface to expose the void results in a coating outer surface roughness of greater than about 60 microinch RA; and, refurbishing coating includes the element Al.

3. The component of claim 1 in which the substrate alloy surface includes a compressive stress that results in at least one increased mechanical property of the substrate alloy surface as a result of the mechanical working.

4. The component of claim 3 in which the increased mechanical property of the substrate alloy surface is fatigue strength.

* * * * *